United States Patent [19]

Perkins

[11] Patent Number: 4,919,428

[45] Date of Patent: Apr. 24, 1990

[54] GOLF PUTTER WITH BLADE TRACKING, TWIST PREVENTION AND ALIGNMENT TRANSFER STRUCTURE, ALIGNMENT MAINTAINING STRUCTURES, AND AUDIBLE IMPACT FEATURES

[76] Inventor: Sonnie J. Perkins, 1214 169th Ave., NE., Bellevue, Wash. 98008

[21] Appl. No.: 240,637

[22] Filed: Sep. 6, 1988

[51] Int. Cl.[5] ..... A63B 53/00

[52] U.S. Cl. ..... 273/164; 273/167 A; 273/167 G; 273/80 C; 273/183 D

[58] Field of Search ..... 273/167 A, 167 R, 167 B–K, 273/169, 78, 80 A, 80 C, 80.2, 81.3, 172, 171, 174, 173, 183 E, 186 D, 194 B; D21/217, 218, 219

[56] References Cited

U.S. PATENT DOCUMENTS

| | | | |
|---|---|---|---|
| D. 179,816 | 3/1957 | Penna | 273/167 D |
| D. 217,567 | 5/1970 | Williams | 273/167 D |
| D. 272,257 | 1/1984 | Perkins | D21/221 |
| D. 294,617 | 3/1988 | Perkins | D21/220 |
| D. 295,206 | 4/1988 | Perkins | D21/220 |
| 1,505,296 | 8/1924 | Smith | 273/167 A |
| 1,913,821 | 6/1933 | Stumpf | 273/174 |
| 3,549,300 | 7/1967 | Pelz | 273/80 C |
| 3,574,349 | 4/1971 | Kropp | 273/167 G |
| 3,873,094 | 3/1975 | Sebo et al. | 273/80.2 |
| 3,955,819 | 5/1976 | Yokich | 273/164 |
| 3,997,170 | 12/1976 | Goldberg | 273/167 E |
| 4,000,902 | 1/1977 | Perkins | 273/164 |
| 4,113,249 | 9/1978 | Beery | 273/78 |
| 4,140,318 | 2/1979 | Izett | 273/167 G |
| 4,231,576 | 11/1980 | Perkins | 273/183 D |
| 4,456,257 | 6/1984 | Perkins | 273/186 C |
| 4,607,846 | 8/1986 | Perkins | 273/171 |

FOREIGN PATENT DOCUMENTS

| | | | |
|---|---|---|---|
| 102307 | 11/1916 | United Kingdom | 273/167 R |
| 160030 | 3/1921 | United Kingdom | 273/167 F |

*Primary Examiner*—Edward M. Coven
*Assistant Examiner*—Dean Small
*Attorney, Agent, or Firm*—William W. Haefliger

[57] ABSTRACT

A putter blade has multiple tracking grooves that extend forwardly in the blade bottom wall; also the blade has an anti-slippage groove that extends laterally in the blade bottom wall; also, the connection of the shaft to the blade, with the shaft axis passing closer to the blade toe than to the blade heel and to the rear of the blade, provides alignment advantages during stroking.

16 Claims, 3 Drawing Sheets

GOLF PUTTER WITH BLADE TRACKING, TWIST PREVENTION AND ALIGNMENT TRANSFER STRUCTURE, ALIGNMENT MAINTAINING STRUCTURES, AND AUDIBLE IMPACT FEATURES

BACKGROUND OF THE INVENTION

Golfers utilizing conventional putters line up the putter blade by placing the blade at right angles to the intended direction of roll of the ball. The intended roll of the ball is usually established by visualizing an imaginary line from the ball to the hole, or an imaginary line from the ball to a spot on the line of intended roll. The putter blade is then set at right angles to this reference line.

Under the current state of the art, a golfer's putting ability depends largely on his ability to correctly establish the putter blade at right angles to this reference line; or to aim a score mark or directional mark that may be incorporated in the current designed putters parallel or perpendicular to the intended line of roll. Current methods are subject to much visual and mechanical error. One prior invention alleviating these problems is disclosed in my U.S. Pat. No. 4,000,902. The present invention improves over that of said prior patent by allowing simplification and re-distribution of weight. After aim is established, a golfer's putting ability is largely dependent on retaining this putter alignment to and during impact with the ball.

SUMMARY OF THE INVENTION

The new putter concept of the present invention corrects many of these aiming problems both pre-stroke and during the stroke. The putter is so constructed that when the putter is placed behind the ball and the handle of the putter lowered, with the golfer in a crouched position directly behind the ball, the incorporated blade alignment and anti-slip structures may be utilized to establish the direction of the blade in a simple, accurate and direct manner.

Additionally, when the putter is lifted from the turf prior to making the stroke, the putter is so balanced that the forces used to lift the putter and hold it in it's address position (just prior to impact position) make a positive contribution to retaining the chosen alignment and continue to do so during the stroke unless the golfer disturbs this function by torque forces from the golfer.

Basically, the golf putter is embodied in the combination that includes:

(a) a shaft, a transversely horizontally elongated blade supported by the shaft, the blade having a substantially vertical planar front face, a turf engaging bottom face located rearwardly of the front face, and a rearward extension of the blade which extends rearwardly and upwardly above the level of the bottom face, (b) grooving means provided to engage the turf and guide the blade if the putter hits the ground as it is stroked forwardly, and to resist twisting of the blade during such stroking, and (c) slip prevention and alignment holding grooving means provided at the rearward extension of the bottom face to engage the turf and block slipping and twisting of the blade as the blade is tilted rearwardly.

As will be seen, the tracking grooving includes multiple grooves upwardly in the blade bottom face to extend forwardly and rearwardly, such grooves spaced apart transversely of the blade; also, the slip prevention grooving typically includes an elongated groove sunk upwardly into the rearward extension of the bottom face to extend transversely on the blade, the multiple tracking grooves (which also prevent twist when engaged with the ground) intersecting the transversely extending slip prevention groove.

These and other objects and advantages of the invention, as well as the details of an illustrative embodiment, will be more fully understood from the following specification and drawings, in which:

DRAWING DESCRIPTION

FIG. 1 is a side elevation, showing a blade incorporating the invention, addressing a golf ball, during stroking;

FIG. 1*a* is a fragmentary side elevation showing rearward tilting of the blade prior to stroking;

DETAILED DESCRIPTION

Figure 2:
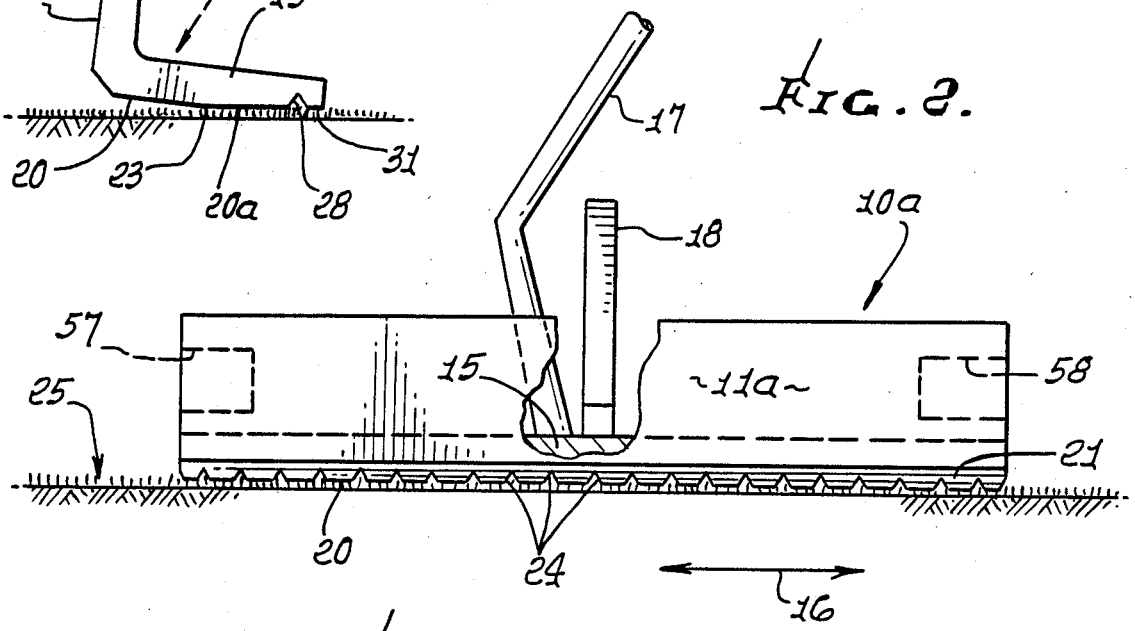
FIG. 2 is a front elevation taken on lines 2—2 of FIG. 1.

In the drawings, the golf putter 10 includes a transversely elongated head or blade 10*a* having an upright front wall 11 defining a generally vertically front face 11*a* during forward stroking as the head closely approaches the golf ball 13. The head has a horizontal top wall 14 and a generally horizontally extending bottom wall 15. The head extends transversely in directions indicated by arrows 16, in FIG. 2. A hozel 17 can be attached at 17*a* to any desired location on the putter head. Number 18 designates an alignment indicator set transverse to the putter face at an angle of 1° to 90° from the putter bottom. The greater the angle the putter shaft can be lowered, the further the golfer can get from the ball and the better his alignment ability becomes.

The bottom wall includes a turf engaging bottom face 20 extending rearwardly of the front face. A planar bevel or bevels 21 may be provided, as shown, to extend between face 11*a* and bottom face 20. A rearward extension of the face 20 is provided at 20*a*, and extends rearwardly and upwardly, at an angle $\alpha$ between 0° and 15° relative to face 20. A transverse line of intersection between surfaces 20 and 20*a* is provided at 23.

Figure 5:
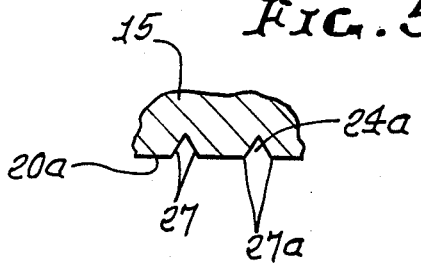
FIG. 5 is an enlarged fragmentary section on lines 5—5 of FIG. 3.

Tracking groove means is provided at the bottom face to prevent twisting of the chosen alignment prior to the stroke and to engage the turf and guide the blade toward the ball, if the blade hits the ground when it is stroked forwardly toward the ball, in a direction parallel to the tracking grooves. As shown, tracking grooves are used at 24, and sunk upwardly into the bottom face 20, to extend forwardly and to be forwardly convergent. Such grooves also extend rearwardly at 24*a* in the rearward extension 20a of the bottom face 20, and at 24b in the rearwardmost extent of the bottom face. Thus, as the blade is stroked forwardly to brush against the turf 25, turf portions progressively and relatively enter the forwardmost "streamlined" grooves 24, and pass through the grooves 24a, from front to rear, bearing against the planar angled side walls 27 of the grooves as seen in FIG. 5, and resisting any tendency of the blade to move in a transverse direction (see arrows 16 in FIG. 2), i.e. keeping the blade "on track", squarely toward the ball. Walls 27 converge upwardly, as shown.

Figure 1:
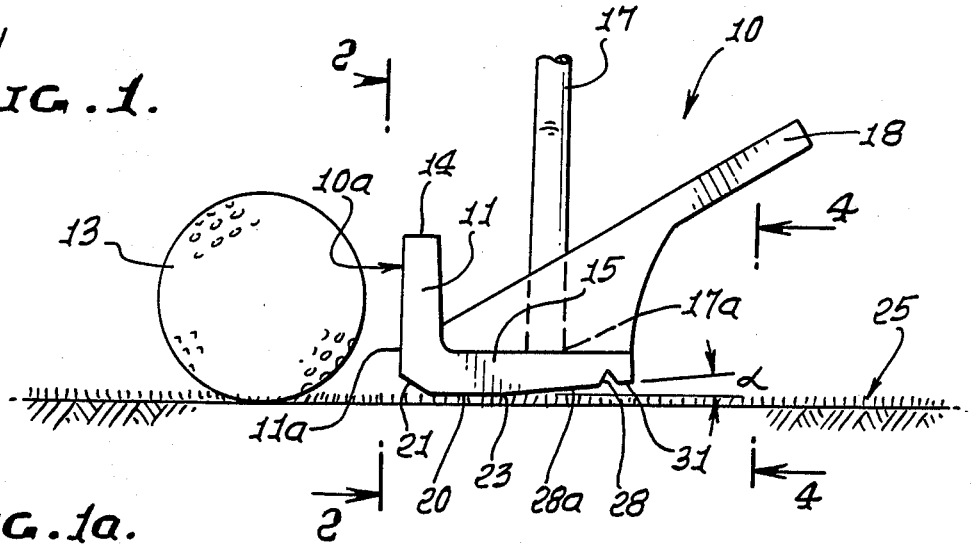
Figure 1A:
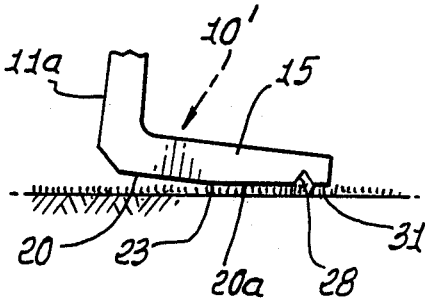
Figure 3:
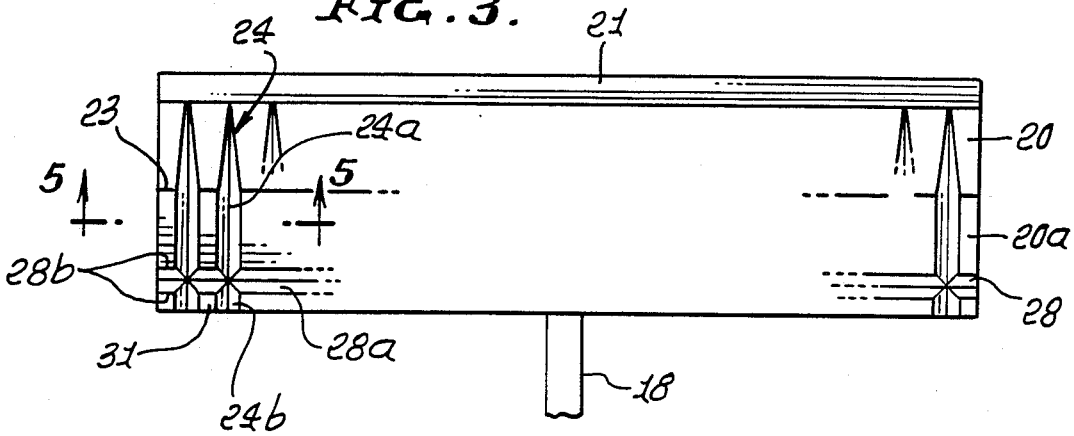
FIG. 3 is a bottom plan view of the blade seen in FIGS. 1 and 2.
Figure 4:
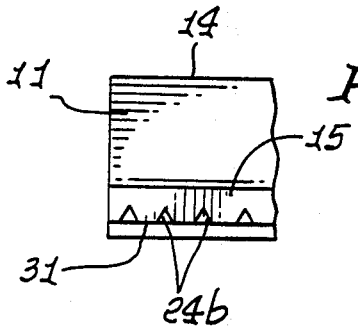
FIG. 4 is a fragmentary rear elevation taken on lines 4—4 of FIG. 1.

Also provided, in the bottom wall 15 and sunk upwardly in the rearward extension 20a of the bottom surface 20, is slip prevention grooving means, to engage the turf and block forward and rearward slippage of the blade, as the blade is tilted rearwardly as in FIG. 1a, locating surface 20a parallel to the ground herewith and parallel to the turf 25. Such grooving includes an elongated groove 28 sunk upwardly in face 20a, to extend transversely from one end of the blade to the other, parallel to edge portion 31 as seen in FIG. 3. The groove 28 has planar, angled side walls 28a that converge upwardly, as shown. Also, groove 28 intersects the forwardly extending groove, as between portions 24a and 24b, and is located near the rearward end of the bottom wall 15. Edge portion 51 provides a turf gripping surface condition that facilitates the holding of the chosen alignment while the golfer assumes his address position.

Accordingly, the non-transverse grooves 24 can, if the turf is contacted, cooperate with the turf to guide the blade in a forward direction during stroking of the ball, and to resist transverse slippage of the blade, as during line-up of the blade, with the ball, prior to stroking of the ball. The transverse groove 28 being higher than the other grooves, does not contact the turf unless a gross stroke error is made.

The angled walls 27 and 28a of the grooves intersect the bottom surface of the blade at defined edges, such as at tracking edges 27a, and slip prevention edges 28b and 31, that engage the turf, to enhance said tracking and anti-slippage function.

Both grooves 24 and 28 are intended to prevent twisting during the time the golfer sights the putter from behind the ball and until he chooses to stroke the ball. The rear edge of the sole and the groove condition 31 are intended, by being parallel to the face and to have a green gripping condition, to facilitate and maintain the chosen aim during this "alignment transfer motion". See blade broken line "tilt" position 10a in FIG. 1a.

Figure 6:
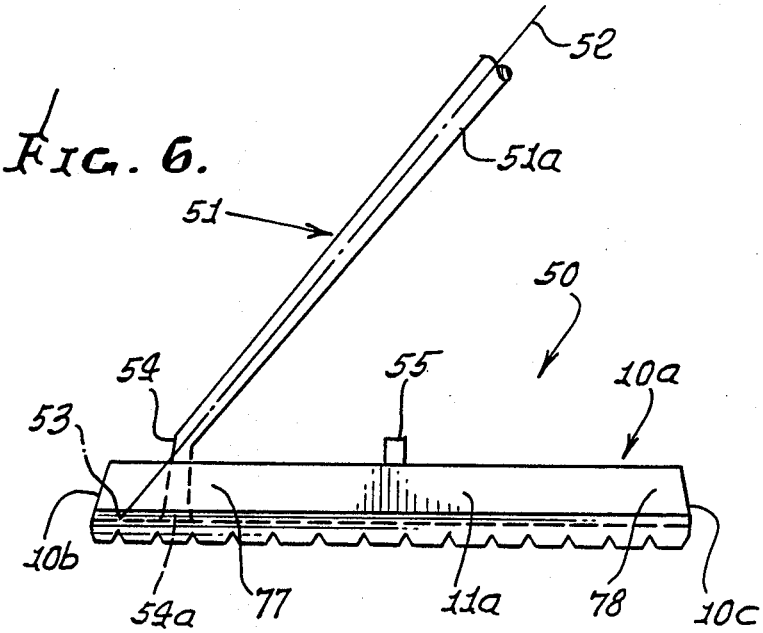
FIG. 6 is a front view of a modified head.
Figure 8:
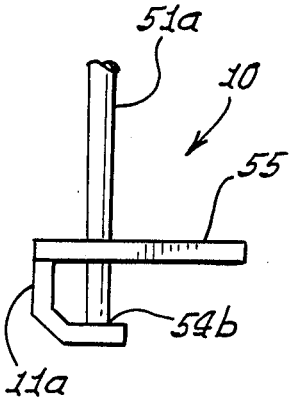
FIG. 8 is an end view of the head of FIG. 7.
Figure 7:
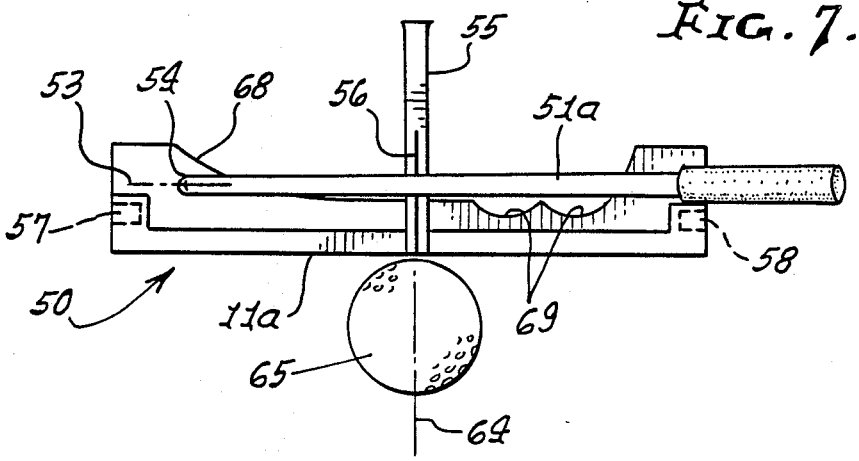
FIG. 7 is a top plan view of the FIG. 6 club.

Referring to FIGS. 6, 7 and 8, they show a modified putter 50 having a blade 10a the same as that described in FIGS. 1–5. Shaft 51 has a straight main length 51a, and a hozel 54 that connects the shaft to the blade. The shaft main length 51a has an axis 52 that extends to a point 53 at the rear of the blade, and closer to the toe 10b of the blade than to the heel 10c, as shown. Hozel 54 bends downwardly attaching to the blade at a different point 54a than the extension of the shaft. A sight indicator 55 is attached to the blade upper extent, and extends at the rear of the blade, but in a forward direction; and a sight line 56 on the indicator extends forwardly in a vertical plane that bisects the blade. The heel and toe have weight ports or are weighted at 57 and 58.

As a result of the shaft being positioned midway between the blade's forward and rearward weight distribution, plus being pointed to the toe side 77 of the toe-heel weight distribution center, and above the up-down weight distribution center, the blade is balanced in such a way that on lifting the putter from the turf the sight indicator remains aimed parallel to the target line and the blade face 11a tends to remain perpendicular to a line 64 that extends forwardly and rearwardly from the gold ball 65.

Because a conventional putter has a shaft that is set at least 10° off of vertical and a human golfer must make a stroke that is to the side or outside of his body structure, such a putter thus normally travels in an upward and around arc on the backstroke about some center of stroke and, hopefully, the putter returns on this same arc in reverse on the forward stroke. The putter face, depending on the amount of mass located outside the shaft toward the toe (MAt) compared to the mass heel side of the shaft (MAh), is affected by the momentum outside the shaft as compared to the momentum inside the shaft. The difference in momentum causes torque about the shaft that the golfer must prevent or overcome during the stroke. The shaft, being between MAt and MAh, moves at certain speeds during the stroke; MAt being outside and moving on a larger arc moves faster than MAh which is on a sharper arc also moves slower than the shaft speeds. To prevent torque about the shaft, Momentum(MOt) should equal Momentum (MOh). Therefore the mass of the toe should be less than that of the heel and this proportion is related to the golfers particular stroke center and the arcs that center creates in the golfer's stroke.

By placing weight ports 57 and 58 at the toe and heel of the blade, respectively, but located along the transverse axis midway between the forward and rear weight distribution, the golfer can be experimentation determine the proper total weight best suited to his game, plus the proper weight distribution between heel and toe as required by his particular stroke center as caused by his natural physical stroke motion. This combination of balance conditions will reduce torque about the shaft caused by the putter head or blade allowing the golfer to return the originally set alignment to the ball for impact. The sight indicator 52 on the blade's rear face, because of its length, gives the blade desired characteristics.

The putter shape being different on the toe side, 77, from the heel side, 78, rings audibly in one manner when a ball is struck on the toe if it is off center, and rings audibly, but differently when struck on the heel and also off center. When struck in the center the vibration characteristics are greatly diminished and the audible tone is almost non-existent. This gives the player a sense as to whether he is striking the ball correctly on the center and whether it is toward the heel or toe. This allows the golfer to monitor his stroke and correct improper actions before they become so large as to create torque about the shaft thus diminishing the effectiveness of the previous described alignment balancing of the blade. See cutouts 68 and 69.

When a moving blade strikes the ball which is at rest, the inertia of the ball applies a resisting force to the moving blade. The further the center of mass of the ball deviates from the center of mass of the blade, the more torque occurs, about the shaft, and, the more the effect on the alignment of the putter. Since the putter is usually gripped lightly for enhanced feel of distance control, this torque has profound effects on successful results. In addition it is difficult to actually see where the blade contacts the ball as the golfer is concentrating on the ball. Therefore, as a teaching and awareness aid, an audible indicator or in the more proper case, a non-audible sound or lack thereof, is helpful.

Figure 9:
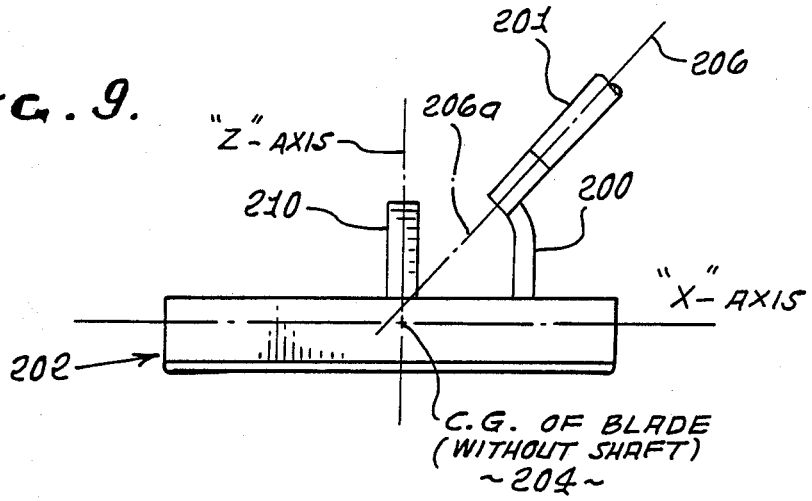
FIG. 9 is a front view of a modified putter head.

In FIG. 9, the shaft hozel 200 of the shaft 201 is joined to the blade 202 at 203, at the heel side of the blade c.g. (center of gravity) 204. A forward extension 206a of the shaft axis 206 intersects the "x""z" plane (at x axis level) at the toe side of the c.g. where:

"x" is an axis through the c.g. that extends lengthwise of the blade,

"z" is a vertical axis through the c.g., and

"y" is an axis through the c.g. normal to "x" and "x".

Figure 10:
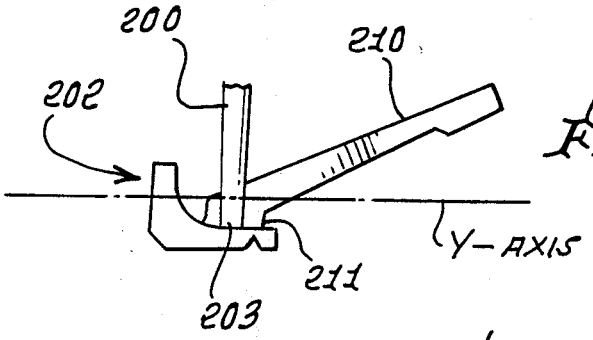
FIG. 10 is an end view of the FIG. 9 head.

The putter blade 202 is shown in ball address position. In FIGS. 9 and 10 the sight indicator 210 is elongated rearwardly and upwardly, and is offset to the toe side of the "z" "y" plane, as shown. It joins the blade at 211. The blade may advantageously have the construction as in FIGS. 1–4.

Figure 11:
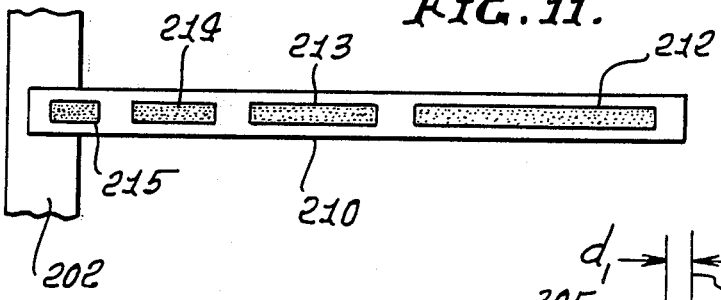
FIG. 11 is a top plan view of a putter sight indicator with graduated sighting portions.

In FIG. 11, the top of the sight indicator 210 has either a continuous or a graduated line position and spaces 212–215 which are longer toward the rear of the blade. They are spaced apart as shown, and may be painted on the top of the indicator to contrast with the color of the indicator. By testing, the spaced lines allow better alignment than a continuous line but some golfer would find a continuous line less distractive prior to putting.

Figure 12:
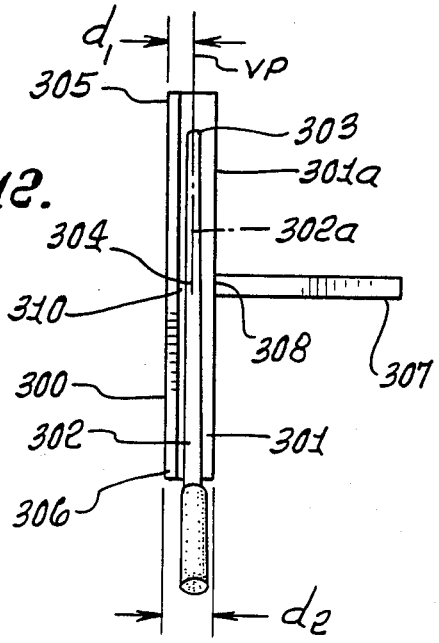
FIG. 12 is a plan view of a modified putter.

FIG. 12 embodies in one putter important features of the invention. The blade includes a ball striking front upright wall 300, and a rearward bottom ledge 301, which may be grooved as described in FIGS. 1–4. The putter shaft 302 is connected at its lower end to the ledge 301 at a location 303, the shaft axis 302*a* intersecting the ledge 301 over and beyond the center or centroid 304 of the head, i.e. closer to toe 305 than to heel 306. A rearwardly elongated alignment indicator 307 projects rearwardly from its connection at 308 to the blade, proximate centroid 304. Indicator 307 may be non-metallic (i.e. plastic) or only partly non-metallic and the remainder metallic, and elongated as shown, to resist blade rotation upon travel of the putter toward the ball. The putter head center of gravity (c.g.) 310 is at the forward end of the sight indicator, rearward of the blade.

The axis 302*a* of the shaft lies in a vertical plane VP parallel to the blade length, the plane VP being closer to the blade front face than to the blade ledge rearward edge 300*a*. Preferably and for best results the distance $d_1$ between plane VP and the front face of the blade is 40% or less of the distance $d_2$ between the front face and the rear edge 301*a*.

I claim:

1. In a golf putter, the combination that comprises (a) a shaft, a traversely horizontally elongated blade supported by the shaft, the blade having a substantially vertical planar front face, a turf engaging bottom face or sole which extends horizontally and is located rearwardly of the front face, a flat rearward extension of the bottom face which extends rearwardly of and upwardly at an angle relative to and above the horizontal level of the bottom face, and a rear face, that extends upwardly, and generally parallel to the front face, (b) twist prevention and tracking grooving means provided at said bottom face to engage the turf and guide the blade if it strikes the turf when stroked forwardly, and for resisting twisting of the blade during such stroking, (c) slip and twist prevention grooving means provided at said rearward extension of the bottom face and rear face for engaging the turf and blocking slipping of the blade as the blade is tilted rearwardly, and when the blade is returned to the normal address position, and (d) said slip and twist prevention grooving means including a first elongated groove sunk upwardly in said rearward extension of the bottom face to extend lengthwise of the blade, said first elongated groove spaced forwardly of said rear face, (e) said slip and twist prevention grooving means including additional multiple grooves sunk upwardly in said rearward extension of the bottom face to extend forwardly and rearwardly, rearwardly of said first elongated groove, and also spaced apart transversely of the blade, (f) said additional multiple grooves having forward ends intersecting said slip prevention groove, and said rear face, (g) said additional multiple grooves each defined by upwardly converging side surfaces which intersect said rearward extension of said bottom face at forwardly elongated edges engagable with the turf during rearward tilting of the blade for resisting blade side slip, or twist.

2. The putter of claim 1 wherein said tracking grooving means includes multiple tracking grooves sunk upwardly in said bottom face to extend forwardly and rearwardly, said multiple tracking grooves spaced apart transversely of the blade, said multiple tracking grooves having forward portions that taper forwardly.

3. The putter of claim 2 wherein said multiple tracking grooves are each defined by upwardly converging side surfaces which intersect said bottom face at forwardly elongated tracking edges engagable with the turf.

4. The combination of claim 2 wherein said multiple tracking groovers also are forwardly convergent toward and into proximity with an angled bevel defined between said front face and said bottom face.

5. The putter of claim 1 wherein said first elongated groove is defined by upwardly converging side surfaces which intersect said rearward extension of said bottom face at transversely elongated edges engagable with the turf during rearward tilting of the blade to resist blade slip, forwardly or rearwardly.

6. The combination of claim 1 wherein the blade is recessed forwardly toward said front face, above said bottom face.

7. The combination of claim 1 wherein the blade has a heel and a toe, and an extension of the shaft has an axis that extends to the rear of the blade closer to the toe than to the heel of the blade, and in an x-axis, z-axis plane through the center of gravity of the blade, where the x-axis extends lengthwise of the blade through the center of gravity, and the z-axis extends vertically through said center of gravity.

8. The combination of claim 7 including a forwardly directed but rearwardly extended sighting indicator carried by the blade approximately mid-way between the toe and heel.

9. The combination of claim 8 wherein the sighting indicator lies in a vertical plane normal to the intersection of the front and bottom faces.

10. The combination of claim 8 wherein an extension of the shaft axis lies in said x-axis, z-axis plane and intersects an x-axis, y-axis plane between 0 and 1½ inches to the toe side of a z-axis, y-axis plane, thus causing the sighting indicator to hang horizontal and the front face to hang vertical when the putter is balanced on the shaft, and wherein the y-axis intersects said center of gravity and is normal to both said x-axis and said y-axis.

11. The combination of claim 8 including structural shapes between the heel and toe sides of the blade which is metallic, to cause the total blade including the sight indicator to ring when it strikes a golf ball off-center, the different structural shapes located between the mid-portion of the blade and the toe, and between the mid-portion of the blade and the heel, said ring being audibly different when struck on the toe side as compared to the heel side and audibly duller when struck at the blade's sweet spot.

12. The combination of claim 7 including weighting means on the blade, at the toe and heel located centrally of the plane of the blade defined by said x-axis and z-axis.

13. The combination of claim 7 including a sight indicator which has a painted sight line to differentiate between the line and the blade color, said line being continuous or having graduated portions and graduated spaces therebetween, with the smaller portions located toward the front face.

14. The putter of claim 1 wherein the blade has a heel and toe, and including weight means masses at said heel and toe, and wherein an extension of the shaft axis balances the masses such that the momentum of the masses during the putter stroke prevents one portion of the blade from causing a torque on the shaft as the putter is swung backward and forward during the putting stroke.

15. The combination of claim 1 wherein the blade also has a rear, rearward of said front face, the axis of the shaft lying in a vertical plane closer to said front face than to said rear.

16. The combination of claim 15 wherein the distance between said vertical plane and said front face is 40% or less of the distance between said front face and said rear edge.

* * * * *